US006202425B1

(12) United States Patent
Arshansky et al.

(10) Patent No.: US 6,202,425 B1
(45) Date of Patent: Mar. 20, 2001

(54) NON-COMPRESSION CASCADE REFRIGERATION SYSTEM FOR CLOSED REFRIGERATED SPACES

(76) Inventors: Yakov Arshansky, 5262 E. Shore Dr., Convers, GA (US) 30094; David K. Hinde, 4311 Coatsworth Dr., Rex, GA (US) 30273; Anthony Papagna, 29069 Kendallwood, Farmington Hills, MI (US) 48334

( * ) Notice: Subject to any disclaimer, the term of this patent is extended or adjusted under 35 U.S.C. 154(b) by 0 days.

(21) Appl. No.: 09/161,335

(22) Filed: Sep. 25, 1998

Related U.S. Application Data

(60) Provisional application No. 60/060,157, filed on Sep. 26, 1997.

(51) Int. Cl.[7] ..... F25D 15/00; F25D 17/00

(52) U.S. Cl. ..... 62/119; 62/333; 165/104.21

(58) Field of Search ..... 62/119, 333; 165/104, 165/21, 27

(56) References Cited

U.S. PATENT DOCUMENTS 2,233,414 * 3/1941 Hubacker ..... 62/333

2,581,044 * 1/1952 Ratcliff ..... 62/333 X

FOREIGN PATENT DOCUMENTS

0195891 * 8/1991 (JP) ..... 165/104.27

* cited by examiner

*Primary Examiner*—William Wayner
(74) *Attorney, Agent, or Firm*—Thomas, Kayden, Horstemeyer & Risley

(57) ABSTRACT

A non-compression cascade refrigeration system 30 for refrigerating a closed refrigerated space includes a cascade condenser 34 in heat exchange relationship with a primary evaporator 24, a cascade evaporator 28 positioned in the refrigerated space 40 and a liquid and vapor separator 42. A first coolant delivery conduit 44 delivers liquid coolant from the cascade condenser 34 to the separator 42 which then provides the coolant through a second coolant delivery conduit 46 to the cascade evaporator 28 for cooling the refrigerated space 40. A first coolant return conduit 50 returns the coolant from the cascade evaporator 28 to the separator 42 where the return coolant is separated into liquid and gaseous coolant, such that the liquid coolant is directed to the second delivery conduit 46 for reuse in the cascade evaporator 28 and the gaseous coolant is directed to a second coolant return conduit 52 and returned to the cascade condenser 34.

15 Claims, 3 Drawing Sheets

NON-COMPRESSION CASCADE REFRIGERATION SYSTEM FOR CLOSED REFRIGERATED SPACES

RELATED APPLICATIONS

This application is based on and claims priority to a U.S. Provisional Application, Serial No. 60/060,157, filed on Sep. 26, 1997.

FIELD OF THE INVENTION

This invention relates to commercial refrigeration systems for enclosed refrigerated spaces which have walk-in freezers or other large chilled spaces and primary mechanical refrigeration equipment in remotely located machine areas for supplying coolant fluid to the evaporators in the chilled spaces, with an intermediate heat exchange system between the primary mechanical refrigeration equipment area and the chilled spaces to reduce the amount of coolant that is communicated to the evaporator in the chilled space.

BACKGROUND OF THE INVENTION

Modern supermarkets require a large amount of refrigeration for freezing and chilling the goods purchased by its customers. Typically, the freezers and coolers are located in random positions about the customer areas of the supermarket, in optimum locations for marketing purposes. In some instances, large closed refrigerated spaces and fixtures, including walk-in freezers or walk-in coolers are provided for butchers and other personnel of the supermarket, and occasionally for customers where large stocks of chilled items are maintained. While these larger closed refrigerated spaces are highly desirable, it is also desirable to use as little refrigerant coolant fluid as possible to chill these spaces. This is because the refrigerants must pass through an evaporator in the chilled space and there is a hazard that the refrigerant will leak into the atmosphere of the closed chilled space and be inhaled by customers, workers, and others. Refrigerants may replace oxygen in a closed space and result in oxygen deprivation, and possibly death by asphyxiation.

As a result of this hazard, federal and state regulations limit the amount of refrigerant that can be used to cool freezer rooms and other large closed refrigerated spaces which can be occupied by a person, either by an employee of the supermarket or by a customer. In most instances, the typical walk-in refrigerated space, etc. requires more refrigerant than is permitted by the federal and local regulations in order to adequately cool the space, particularly when people frequently move into and out of the chilled space. The result of this situation is that walk-in refrigerated spaces and other large closed refrigerated spaces that have frequent entry of people and therefore a large refrigeration load are not commonly available in typical supermarkets.

Thus, it can be seen that it would be desirable to have available to supermarkets and other businesses a large closed refrigerated space that can be adequately chilled for its intended purposes without requiring a volume of refrigerant fluid that is in excess of the standards set by federal and state regulatory bodies to directly communicate with the evaporator in the refrigerated space.

SUMMARY OF THE INVENTION

Briefly described, the present invention comprises a commercial refrigeration system for a large closed refrigerated room having a high refrigeration load that is to be used by supermarkets and other large refrigerated installations. The refrigeration system includes an intermediate heat exchange non-compression cascade refrigeration system that is connected between a refrigerated space and a conventional or "primary" refrigerant compressor system of the type typically located in the machine room of a large supermarket. The cascade refrigeration system utilizes a small amount of refrigerant fluid in a closed loop configuration that is in direct communication with the evaporator of the refrigerated space. The intermediate heat exchange system comprises a non-compression cascade refrigeration system, e.g. a refrigeration system which operates without the use of compressors, that typically does not require pumps or other mechanical means for moving the coolant fluid, but which relies upon gravity, its own internal pressures and changes of phase of the coolant fluid for movement through heat exchangers.

More specifically, the intermediate cascade refrigeration system includes a condenser that is matched in heat exchange relationship with an evaporator of the primary refrigeration compressor system for cooling the refrigerant fluid of the cascade system. An evaporator of the cascade refrigeration system is positioned in the refrigerated space. A liquid and vapor separator is positioned in the coolant delivery and return lines between the evaporator and the condenser of the cascade system. A first coolant delivery conduit extends from the cascade condenser to the separator for delivering coolant in liquid phase to the separator, and a second coolant delivery conduit extends between the separator and the cascade evaporator for delivering coolant in liquid phase to the evaporator. Likewise, a first coolant return conduit extends between the cascade evaporator and the separator for returning coolant in a gaseous and liquid state from the cascade evaporator to the separator, and a second coolant return conduit extends between the separator and the cascade condenser for returning the coolant in a gaseous state to the cascade condenser.

When in operation, the refrigerant fluid being returned from the cascade evaporator in the chilled space moves from the evaporator to the separator in both liquid and gaseous states. The coolant that is in liquid form falls to the bottom of the separator where it is returned to the cascade evaporator, while the coolant that is in vapor form rises from the separator and moves upwardly to the cascade condenser. The cascade condenser condenses the coolant from vapor form to liquid form, and the liquid coolant is delivered by the first delivery conduit back to the separator. The liquid in the separator is then moved by gravity downwardly through its second delivery conduit to the cascade evaporator in the chilled space. Fans are used to circulate air in the chilled space to transfer the heat between the cascade evaporator and the chilled space.

The cascade refrigeration system does not require a compressor to move its fluid between the cascade condenser and the cascade evaporator in the chilled space, which is believed to result in a reduction of a hazard of leakage of the coolant from the system. Also, the cascade system can be located in the immediate vicinity of the chilled space, typically above the chilled space so as to take advantage of gravity movement of the refrigerant. This close proximity of the cascade refrigeration system with the chilled space results in only a small amount of coolant fluid being required to pass through the closed circuit of the cascade refrigeration system.

Thus, it is an object of this invention to provide an improved refrigeration system for walk-in coolers and freezers of the type used in supermarkets, which uses only a small amount of refrigerant fluid in the refrigerated space and which would avoid leakage of large amounts of refrigerant fluid in the refrigerated space.

Other objects, features and advantages of this invention will become apparent upon reading the following specification.

DETAILED DESCRIPTION OF THE PREFERRED EMBODIMENT

Figure 1:
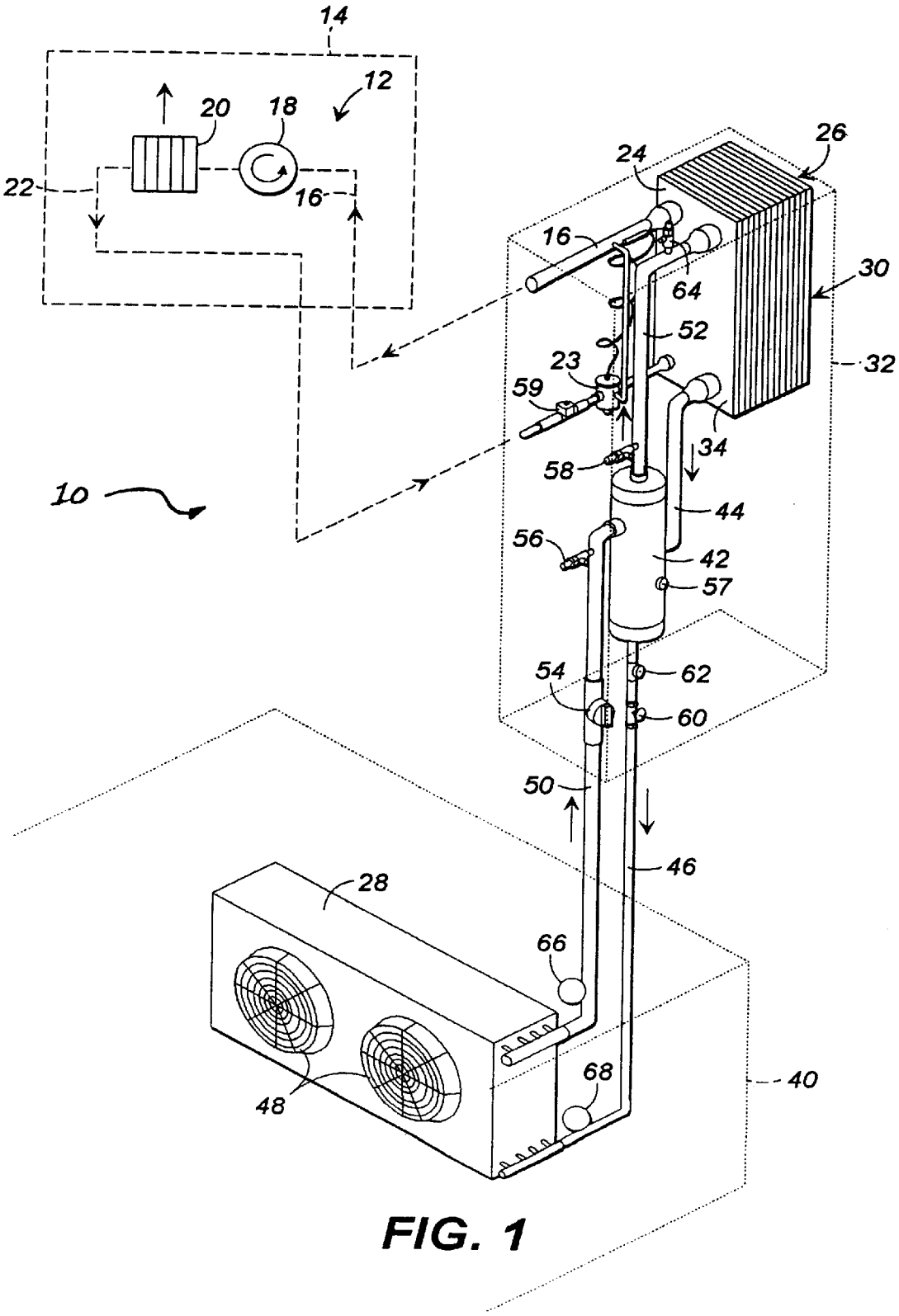
FIG. 1 is a perspective illustration of the Cascade Refrigeration System as it is connected to a conventional primary refrigeration system.
Figure 2:
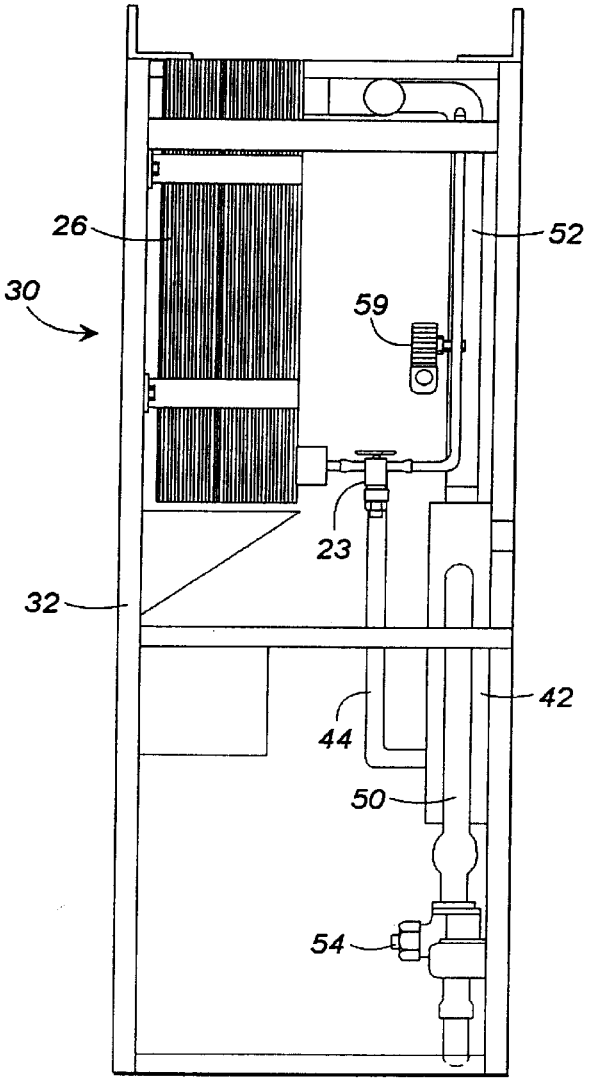
FIG. 2 is a front elevational view of the Cascade Refrigeration System.
Figure 3:
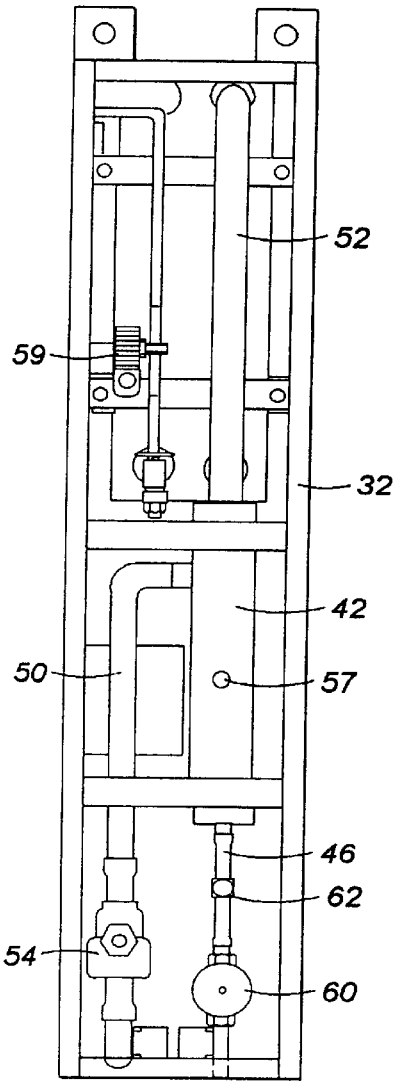
FIG. 3 is a side elevational view of the Cascade Refrigeration System.
Figure 4:
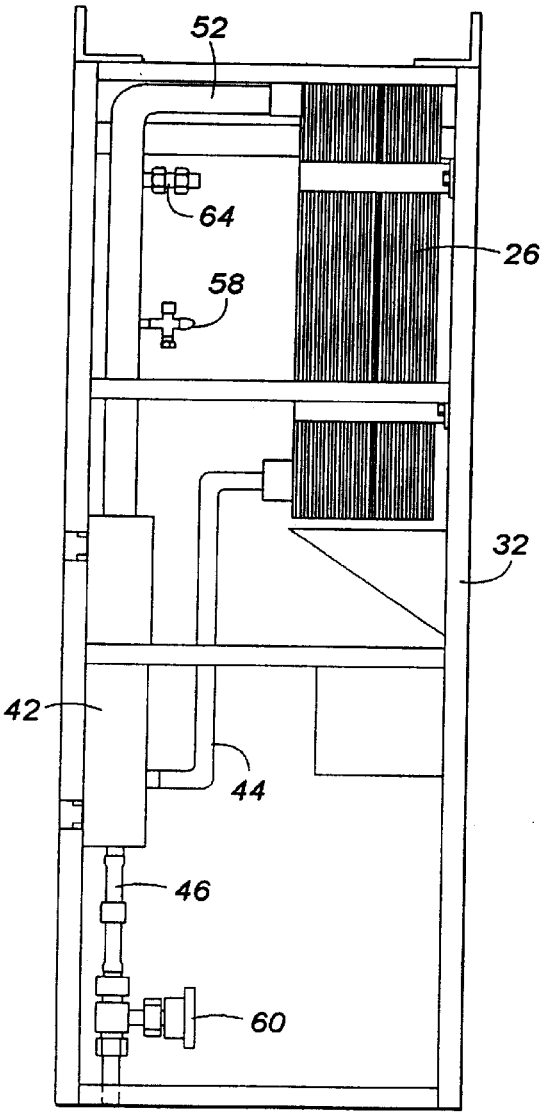
FIG. 4 is a rear elevational view of the Cascade Refrigeration System.
Figure 5:
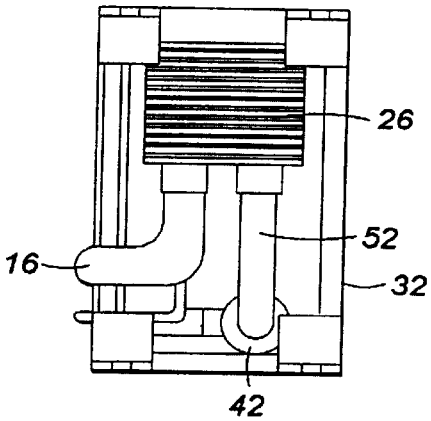
FIG. 5 is a top view of the Cascade Refrigeration System.

Referring now in more detail to the drawings, in which like numerals indicate like parts throughout the several views, FIG. 1 illustrates the refrigeration system 10 which includes a conventional primary refrigeration system 12 that is located in a remote area of a supermarket, such as on the roof or on the roof and in a machine room, as generally indicated by the dash lines 14. Coolant is received through a return conduit 16 at the compressor 18 and delivered to the condenser 20, in which the coolant changes into a liquid state. The coolant moves from the condenser 20 through the delivery line 22 back into the supermarket and is received through expansion valve 23 in a primary evaporator 24, whereby the coolant absorbs heat.

The evaporator 24 is part of a prior art condenser-evaporator plate heat exchanger 26 such as a brazed plate heat exchanger produced by Swep, Inc. or by Alfa Laval Thermal, Inc.

The non-compression cascade refrigeration system 30 has its components, except for its evaporator, supported in a framework 32 as indicated by the dash lines in FIG. 1, and includes a condenser 34 that is part of the condenser-evaporator plate heat exchanger 26, and evaporator 28 that is located within the walk-in refrigerated space 40 as indicated by the dash lines in FIG. 1, and a liquid-vapor separator 42. A first delivery conduit 44 delivers coolant in a liquid form from the condenser 34 of the condenser-evaporator plate heat exchanger 26 to the separator 42. A second delivery conduit 46 transmits liquid coolant from the separator 42 in a downward direction to the cascade evaporator 28 in the refrigerated space 40. The coolant changes from a liquid state to a liquid and gaseous state in the evaporator 28, with electric fans 48 moving air across the evaporator, so that the evaporator chills the air. So configured, the first and second coolant delivery conduits form a coolant delivery system for delivering coolant in a liquid state from the cascade condenser to the evaporator.

A first return conduit 50 guides the coolant from the evaporator 28 upwardly to the separator 42. As the coolant moves into the separator 42, some of the coolant will be in liquid form and the balance of the coolant will be in gaseous form. The coolant in liquid form will migrate to the bottom of liquid-vapor separator 42, and will be available for movement through the second delivery conduit 46 back to the evaporator 28. The vapor in the separator 42 will rise through the second return conduit 52 and be recycled through the condenser side 34 of the heat exchanger 26. So configured, the first and second coolant return conduits form a coolant return system for returning coolant in a gaseous state from the evaporator to the cascade condenser.

The elements illustrated in FIG. 1 include a ball valve 54, a charging valve 56, a sight glass 57, a transducer valve 58, upper cascade liquid refrigerant solenoid valve 59, a liquid regulating valve 60, sight glass 62, relief valve 64, and temperature probes 66 and 68, all of which can be used to initially charge and to monitor the cascade refrigeration system.

As illustrated in FIGS. 2–5, the non-compression cascade refrigeration system 30 has a supporting framework 32 which enables the various components to be assembled in a cluster that can be mounted in the ceiling of the supermarket, or can be mounted atop the refrigerated space 40. This places the cascade refrigeration system in the immediate vicinity of the refrigerated space 40, and permits a minimum amount of refrigerant to be utilized in direct communication with the cascade evaporator 28 that is located in the interior of the refrigerated space 40.

Figure 6:
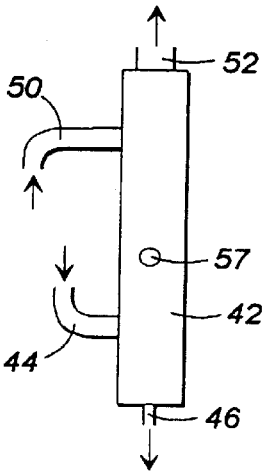
FIG. 6 is a side elevational view of the liquid-vapor separator.

As shown in FIG. 6, the first return conduit 50 is connected to the separator 42 at a higher position than the connection of the first delivery conduit 44, so that the vapor is returned from the cascade evaporator 28 at a higher position than the liquid from the cascade condenser 34. The sight glass 57 is positioned at the desired height of the level of the liquid coolant in the separator.

The non-compression cascade refrigeration system is primarily designed to refrigerate closed refrigerated spaces (coolers/freezers) and fixtures (merchandise cases) in supermarkets. However, this system can be used for many other commercial and industrial applications where similar requirements are necessary.

This system provides a cooling effect for refrigerated objects using the lower cascade loop with limited charge of refrigerant. Generally, the system consists of two elements: an evaporator coil located inside the refrigerated space, and a condensing heat exchanger, referred to herein as the condenser-evaporator. These elements are integrated into one circuit forming the lower cascade loop. The circulation of the refrigerant from the evaporator to the condenser inside of the cascade loop is provided by natural convection. The condensation of the evaporated refrigerant, provided in the condenser-evaporator heat exchanger 30, is similar to a compression cascade cycle. However, only the evaporator side of the condenser-evaporator in the primary refrigeration cycle uses a compression pump.

Due to the separation of the compressor and receiver from the refrigerated space and the substantially reduced quantity of the connecting pipes in the lower cascade loop, there is a possibility to use a reduced charge of refrigerant coolant fluid which could possibly leak into the refrigerated space. Since this loop is separated from the primary compression system, only the refrigerant charge in the lower cascade loop will be considered as the "Quantity of Refrigerant per Occupied Space" in accordance with the ANSI/ASHRAE Standard 15-1994, Safety Code for Mechanical Refrigeration, Uniform Fire Code and Uniform Mechanical Code. Thus, this system can be used whenever a restriction of the quantity of refrigerant per occupied space is required by Standard of Uniform Fire Protection and Building Codes.

The foregoing description and illustration set forth a preferred embodiment of the invention. Variations and modifications thereof can be made without departing from the spirit and scope of the invention.

We claim:

1. In a commercial refrigeration system, including a primary refrigeration system having a compressor system for compressing and delivering coolant through a primary condenser, through a delivery conduit to the vicinity of a space that is to be refrigerated, an expansion valve for expanding the coolant from a liquid into a gas, a primary evaporator for receiving the coolant from the expansion valve and a return conduit or returning the coolant in a gaseous form from the primary evaporator to the compressor system for re-compression, the improvement therein comprising:

a non-compression cascade refrigeration system in heat exchange relationship with said primary refrigeration system, said cascade refrigeration system comprising:

a cascade condenser in heat exchange relationship with said primary evaporator;

a cascade evaporator positioned in the refrigerated space;

a liquid and vapor separator;

a first coolant delivery conduit constructed and arranged to deliver coolant from said cascade condenser to said separator;

a second coolant delivery conduit constructed and arranged to deliver coolant from said separator to said cascade evaporator in the refrigerated space;

a first coolant return conduit constructed and arranged to return coolant from said cascade evaporator to said separator;

a second coolant return conduit constructed and arranged to return coolant from said separator to said cascade condensing chamber; and said separator including means for separating liquid coolant from gaseous coolant and directing gaseous coolant to said second coolant return conduit and to said cascade condenser and directing liquid coolant to said second delivery conduit and to said cascade evaporator.

2. The non-compression cascade refrigeration system of claim 1, wherein said separator is arranged in a substantially vertical orientation and wherein said first coolant return conduit is connected to said separator at a first position and wherein said first coolant delivery conduit is connected to said separator at a second position such that said second position is at least partially lower, in relation to said separator, than said first position.

3. The non-compression cascade refrigeration system of claim 2, wherein said second coolant delivery conduit is connected to said separator at a third position such that said third position is at least partially lower, in relation to said separator, than said second position.

4. The non-compression cascade refrigeration system of claim 3, wherein said second coolant return conduit is connected to said separator at a fourth position such that said fourth position is at least partially higher, in relation to said separator, than said first position.

5. The non-compression cascade refrigeration system of claim 1, wherein said first coolant return conduit includes a ball valve such that said ball valve substantially prevents liquid refrigerant from flowing from said separator, into said first coolant return conduit, through said ball valve and then into said cascade evaporator.

6. The non-compression cascade refrigeration system of claim 1, wherein said second coolant delivery conduit includes a regulating valve such that said regulating valve provides an adjustable flow of coolant to said cascade evaporator.

7. In a commercial refrigeration system for refrigerating a space, including a primary refrigeration system having a compressor for compressing and delivering coolant through a primary condenser, through a primary delivery conduit, through an expansion valve adjacent the refrigerated space for expanding the coolant from a liquid into a gas, though a primary evaporator for receiving the coolant from the expansion valve and through a primary return conduit for returning the coolant in a gaseous form from the primary evaporator to the compressor system for re-compression, the improvement therein comprising:

a non-compression cascade refrigeration system in heat exchange relationship with said primary refrigeration system, said cascade refrigeration system comprising:

a cascade condenser in heat exchange relationship with said primary evaporator, a cascade evaporator positioned in the refrigerated space;

a coolant delivery system constructed and arranged to deliver coolant in a liquid state from said cascade condenser to said cascade evaporator and to return coolant in a gaseous state from said cascade evaporator to said cascade condenser;

said coolant delivery system including a liquid and vapor separator, a first coolant delivery conduit constructed and arranged to deliver coolant from said cascade condenser to said separator and a second coolant delivery conduit constructed and arranged to deliver coolant from said separator to said cascade evaporator in the refrigerated space, and a first coolant return conduit constructed and arranged to return coolant from said cascade evaporator to said separator and a second coolant return conduit constructed and arranged to return coolant from said separator to said cascade condenser;

said separator configured to separate liquid coolant from gaseous coolant such that gaseous coolant is directed to said second coolant return conduit and to said cascade condenser and liquid coolant is directed to said second delivery conduit and to said cascade evaporator.

8. The non-compression cascade refrigeration system of claim 7, wherein said second coolant return conduit is connected to said separator at a first position and said second coolant delivery conduit is connected to said separator at a second position, and wherein said first position and second position are vertically displaced from each other such that said second position is lower than said first position.

9. The non-compression cascade refrigeration system of claim 7, wherein said first coolant delivery conduit is connected to said separator at a third position such that said third position is lower than said first position.

10. The non-compression cascade refrigeration system of claim 9, wherein said first coolant return conduit is connected to said separator at a fourth position such that said fourth position is lower than said first position and higher than said third position.

11. The non-compression cascade refrigeration system of claim 7, wherein said second coolant return conduit is connected to said separator at a first connection, said second coolant delivery conduit is connected to said separator at a second connection, said first coolant delivery conduit is connected to said separator at a third connection and said first coolant return conduit is connected to said separator at a fourth connection, and wherein said first, second, third and fourth connections are vertically displaced in a sequenced arrangement such that at least a portion of said third connection is higher than said second connection, at least a portion of said fourth connection is higher than said third connection and at least a portion of said first connection is higher than said fourth connection.

12. A method of refrigerating a space, comprising:

providing a heat exchanger in the vicinity of a space;

cooling said heat exchanger with a first coolant;

cooling a second coolant with said heat exchanger;

delivering said second coolant in liquid form from said heat exchanger to a liquid and vapor separator;

delivering the second coolant in a liquid form from said liquid and vapor separator to a cascade evaporator positioned in the space;

blowing air across said cascade evaporator to refrigerate the space;

delivering said second coolant from said cascade evaporator to said liquid and vapor separator;

separating said second coolant in the separator into liquid and gas;

directing gaseous coolant separated from the second coolant to said heat exchanger; and directing liquid coolant separated from the second coolant to said cascade evaporator.

13. The method according to claim 12, wherein the step of cooling said heat exchanger comprises the steps of:

providing the first coolant in liquid form in a delivery conduit;

expanding the first coolant into a gas;

delivering the first coolant from the delivery conduit to said heat exchanger;

removing said first coolant in a gaseous form from said heat exchanger;

compressing the first coolant into liquid form; and returning the liquid first coolant to said delivery conduit.

14. A commercial refrigeration system comprising:

a refrigerated space, a primary refrigeration system and a noncompression cascade refrigeration system in heat exchange relationship with said primary refrigeration system, said cascade refrigeration system located at said refrigerated space;

said primary refrigeration system including a primary condenser, a primary evaporator, an expansion valve, and compressor means for compressing coolant fluid received from said primary evaporator and delivering the coolant fluid through said primary condenser, through said expansion valve and to said primary evaporator; and said cascade refrigeration system including a cascade condenser in heat exchange relationship with said primary evaporator, a cascade evaporator in heat exchange relationship with said refrigerated space, with said cascade evaporator positioned at a height lower than the height of said cascade condenser for moving coolant fluid in a liquid state under the force of gravity from said cascade condenser to said cascade evaporator; and a liquid and vapor separator for receiving coolant from said cascade condenser and said cascade evaporator and separating liquid coolant from gaseous coolant and directing gaseous coolant to said cascade condenser and directing liquid coolant to said cascade evaporator.

15. The commercial refrigeration system of claim 14, wherein:

said primary condenser is positioned remotelv from said refrigerated space, said primary evaporator is positioned adjacent said refrigerated space, and said cascade condenser is juxtaposed said primary evaporator.

* * * * *